United States Patent [19]

Wrightson

[11] 4,443,386

[45] Apr. 17, 1984

[54] EVAPORATIVE COOLER PAD FRAME SUPPORT

[75] Inventor: Robert W. Wrightson, St. Marys, Australia

[73] Assignee: F.F. Seeley Nominees Pty. Ltd., St. Marys, Australia

[21] Appl. No.: 387,925

[22] Filed: Jun. 14, 1982

[30] Foreign Application Priority Data

Jun. 19, 1981 [AU] Australia ..... PE9366

[51] Int. Cl.[3] ..... B01F 3/04

[52] U.S. Cl. ..... 261/29; 261/106; 261/DIG. 41

[58] Field of Search ..... 261/DIG. 41, 106, 29

[56] References Cited

U.S. PATENT DOCUMENTS

| | | | |
|---|---|---|---|
| 1,384,938 | 7/1921 | Crane | 261/106 |
| 2,210,429 | 8/1940 | Pietzsch | 261/106 |
| 2,356,757 | 8/1944 | Fleisher | 261/106 |
| 2,588,612 | 3/1952 | Brookins | 261/29 |
| 3,147,319 | 9/1964 | Goettl | 261/29 |
| 3,867,486 | 2/1975 | Nagele | 261/29 |
| 4,158,679 | 6/1979 | Yeagle | 261/106 |
| 4,309,365 | 1/1982 | Van Ness | 261/106 |
| 4,338,264 | 7/1982 | Seeley | 261/29 |

*Primary Examiner*—Tim R. Miles

*Attorney, Agent, or Firm*—Jay L. Chaskin

[57] ABSTRACT

A baffle is upstanding from the base of an evaporative cooler tank, and a spreader has a depending flange, the pad frames having their lower ends located and supported by the upper edge of the baffle and their upper ends engaged and located by the depending spreader flange.

10 Claims, 5 Drawing Figures

EVAPORATIVE COOLER PAD FRAME SUPPORT

This invention relates to support means for supporting evaporative pad frames in an evaporative cooler.

BACKGROUND OF THE INVENTION

An evaporative cooler comprises a water tank, evaporative pads contained in respective pad frames upstanding from the tank, and a spreader above the evaporative pads arranged to spread water pumped from the tank over the upper edges of the pads so that the water percolates downwardly and returns to the tank for recirculation. At the same time, air is drawn inwardly into the housing of the cooler by fan which is a short distance from the pad frames, the air passing through the wetted evaporative pads and thereby evaporating some water as it percolates downwardly, and the air which has been thus cooled is blown outwardly from the cooler case to provide sensible cooling for a space.

One of the objects of this invention is to provide means whereby the evaporative pads are easily removed for cleaning, and can be easily accurately relocated with respect to the tank, yet wherein there is little likelihood of air by-passing the pads.

BRIEF SUMMARY OF THE INVENTION

In one embodiment of this invention a baffle is upstanding from the base of an evaporative cooler tank, and a spreader has a depending flange, the pad frames having their lower ends located and supported by the upper edge of the baffle and their upper ends engaged and located by the depending spreader flange.

More specifically, the invention consists of support means for supporting evaporative pad frames and their pads in an evaporative cooler of the type having a water tank, a water spreader located above the tank, a motor driven blower between the spreader and the tank, and a pump arranged to pump water from the tank to the spreader, the pad frames being at a distance from the blower and extending downwardly from the spreader towards the tank to intercept water when discharged from the spreader, said support means comprising a baffle and means locating the baffle to be upstanding from the base of the tank, support surfaces on the upper edge of the baffle supporting and locating the lower ends of the respective said pad frames, and a flange depending from the periphery of the spreader engaging and locating the upper ends of said frames.

One of the problems which has been encountered in the past has been rapid build up of salts and other solids thrown out from water upon evaporation when very hard or very dirty water is used. In order to ensure effective operation, it is important that cleaning take place after a certain amount of build up, but it is difficult for a user to ascertain when such cleaning should take place. In an embodiment of this invention there is provided means to limit the flow of water from outside of the baffles to a pump contained within the tank when the build up reaches a level which is sufficiently high that cleaning should take place. This provides water flow inhibit means and water enters the interior portion of the tank containing the pump at a reduced rate, and it becomes evident to the user that cleaning is required. With this invention cleaning is very easily effected, since the baffles can be simply lifted out once the pads have been removed.

BRIEF DESCRIPTION OF THE DRAWINGS

An embodiment of the invention is described hereunder with reference to and is illustrated in the accompanying drawings, in which.

Figure 1:
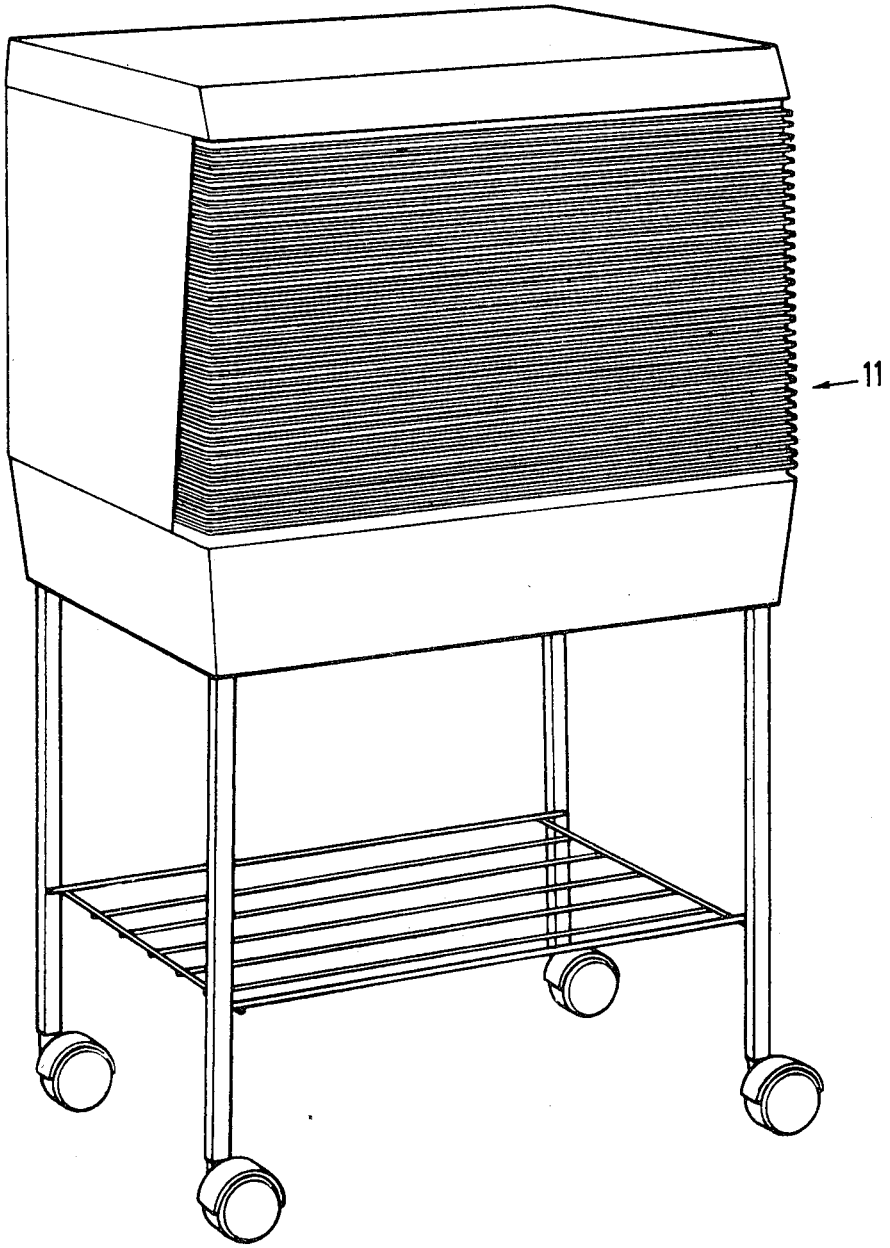
FIG. 1 is a perspective view of a cooler.
Figure 2:
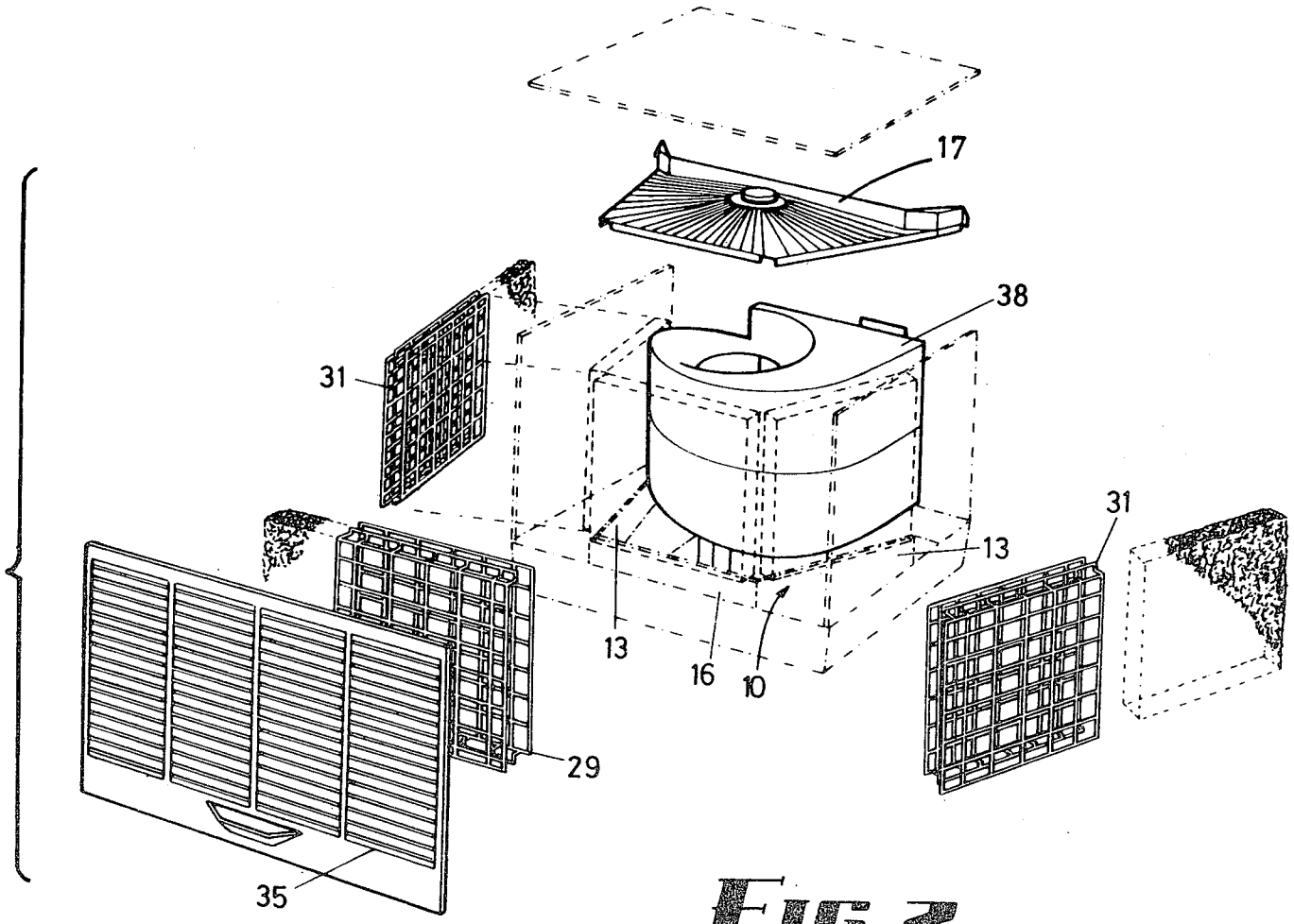
FIG. 2 is a perspective "exploded" view showing the arrangement of the evaporative pad frames and their pads.
Figure 3:
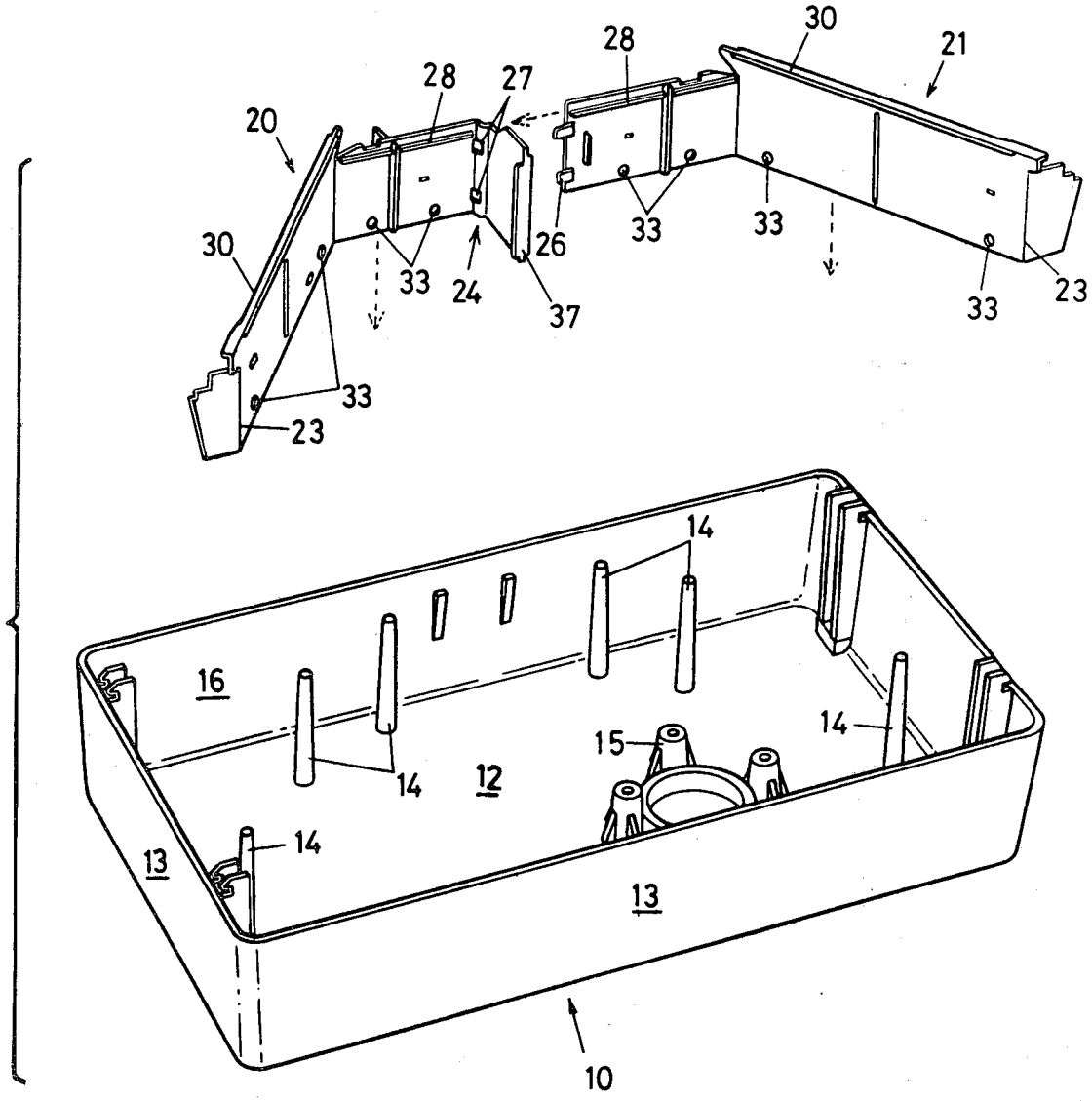
FIG. 3 is a perspective "exploded" view showing the water tank and baffle arrangement.
Figure 4:
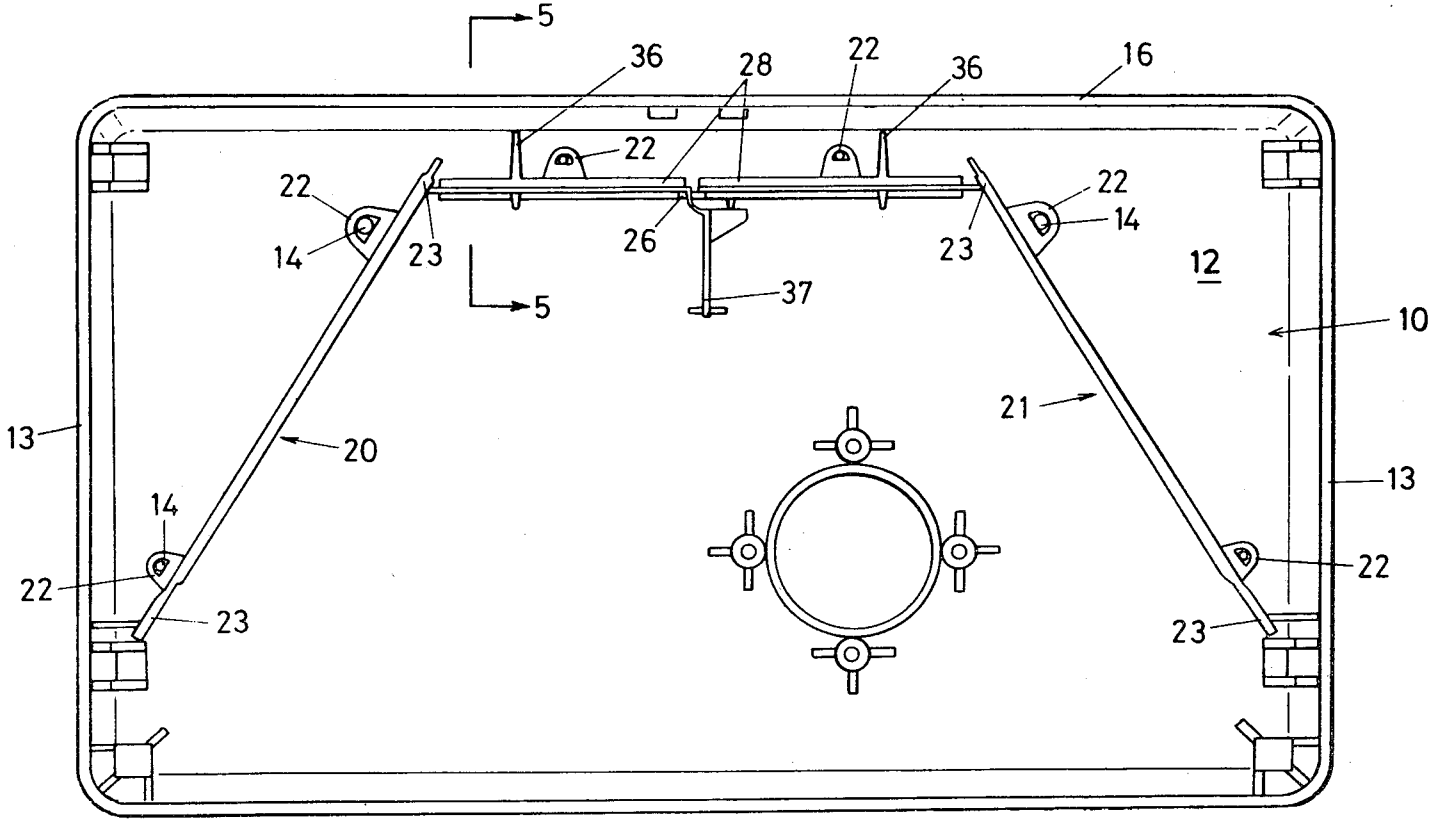
FIG. 4 is a plan view of the tank and baffle assembly.
Figure 5:
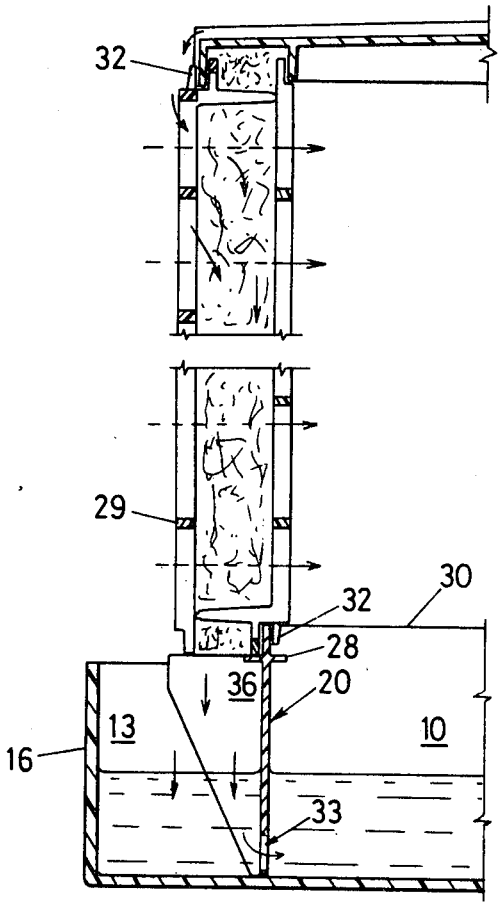
FIG. 5 is a fragmentary section taken on line 5—5 of FIG. 4 but showing a pad and pad frame engaging and located by the baffle and the depending flange of the spreader.

In this embodiment a tank 10 for an evaporative cooler 11 comprises a comparatively flat base 12 and upstanding side walls 13. The base 12 of the tank has upstanding therefrom six baffle locating spigots 14 (in addition to the motor support spigots 15), two being located a short distance inwardly from the rear wall 16 and two inwardly from each of the side walls 13. The spigots 14 are spaced apart in three separate alignments, and there are provided two baffle portions 20 and 21 each having outstanding tabs 22 which engage respective spigots 14 and are thereby located to be upstanding from the base 12. Each baffle portion is formed from plastics material as a sheet like member with reduced thickness strips to constitute a pair of hinges 23 (portion 20 has a further hinge 24 described below). One of the hinges 23 is located between a spigot 14 near the rear wall and two spigots near one of the sides 13, and the second hinge 23 is located forwardly of the two side spigots 14. Each baffle portion is formed to a somewhat of a Z shape, excepting that the portion of the baffle which is adjacent the side wall diverges away forwardly from the corresponding portion of the other baffle (FIG. 4). The front end of each baffle portion lies contiguous with the inner surface of a respective side wall 13 and the other end abuts edge to edge the corresponding end of the other baffle portion. Tabs 26 project from baffle portion 21 and enter apertures 27 in a curved portion of hinge 24 (FIG. 3) so as to interengage the two portions, before the baffle is placed into the tank 10. The upper edges of the baffles have flanges 28 which form support surfaces for the rear pad frame 29 (FIG. 5) while the upper edges 30 of the side portions form support surfaces for the side pad frames 31 which slide inwardly into the cooler from the rear. All the support surfaces are located slightly above the side to enable the side pad frames to be slid across while supported by the upper edge of the baffle on each side, and to enable the rear pad frame 29 to be located inwardly, lifted, and then lowered onto the flanges 28 close to the rear wall of the tank, as shown in FIG. 5. Tabs 32 on the pad frame co-operate with portions of the frame to form channels in end elevation for retention purposes.

The lower edge of each baffle is provided with a plurality of water flow apertures 33 so that a water flow space exists past the baffles from the "outside" to the "inside" area of the tank, the latter area being the area which contains a pump. Build up of sludge in the base of tank 10 will inhibit this flow, but the pad frames and baffles are so easily removed that cleaning is facilitated. To assist in simplifying cleaning, the rear panel 35 (FIG.

2) is a simple lift-out panel quickly removable or replaceable with respect to the cooler cabinet.

In lieu of, or as well as the upwardly facing spigots on the base of the tank, there may be provided angle section supports. Furthermore, the rear portions of respective baffle portions are each provided with rearwardly extending flange supports 36 the upper edges of which assist in supporting the lower edge of the rear pad frame support. The forwardly projecting portions 37 of baffle portion 20 supports the blower scroll 38. A water spreader 18 is located above the scroll 38, the scroll 38 also comprising a motor driven blower.

A consideration of the invention will indicate that it is very simple and provides means whereby assembly can be quickly and easily effected with inexpensive parts. However the invention provides a satisfactory baffle which will support the lower edges of the three pad frames used in the evaporative cooler and described in my co-pending application No. 388,111, filed June 14, 1982.

Various modifications in structure and/or function may be made by one skilled in the art to the disclosed embodiments withour departing from the scope of the invention as defined by the claims.

I claim:

1. Support means for supporting evaporative pad frames and their pads in an evaporative cooler of the type having a water tank, a water spreader located above the tank, a motor driven blower between the spreader and the tank, and a pump arranged to pump water from the tank to the spreader, the pad frames being at a distance from the blower and extending downwardly from the spreader towards the tank to intercept water when discharged from the spreader, said support means comprising:

a baffle and means locating the baffle to be upstanding from the base of the tank, the locating means comprising a plurality of baffle locating spigots upstanding from the base and a corresponding plurality of tabs outstanding from the baffle, each said tab having an aperture the walls of which slidably engage a respective said spigot when the baffle is within the tank, support surfaces on the upper edge of the baffle supporting and locating the lower ends of the respective said pad frames, and a flange depending from the periphery of the spreader engaging and locating the upper ends of said frames.

2. Support means according to claim 1 wherein said baffle comprises two baffle portions, and means interengaging said portions end to end.

3. Support means according to claim 1 wherein said baffle contains water flow apertures extending through its walls near their lower edges.

4. Support means according to claim 1 wherein said support surfaces include support flanges extending near the upper edge of the rear of the baffle.

5. Support means according to claim 1 wherein said baffle comprises a pair of side walls which diverge in a forward direction, said support surfaces including the upper edges of the baffle side walls, respective said pad frames being slidable over those upper edges.

6. Support means for supporting evaporative pad frames and their pads in an evaporative cooler of the type having a water tank, a water spreader located above the tank, a motor driven blower between the spreader and the tank, and a pump arranged to pump water from the tank to the spreader, the pad frames being at a distance from the blower and extending downwardly from the spreader towards the tank to intercept water discharged from the spreader, said support means comprising:

a baffle comprising a pair of side walls which diverge in a forward direction and means locating the baffle to be upstanding from the base of the tank, support surfaces on the upper edge of the baffle supporting and locating the lower ends of the respective said pad frames, said support surfaces including the upper edges of the baffle side walls, respective said pad frames being slidable over those upper edges, and a flange depending from the periphery of the spreader engaging and locating the upper ends of said frames.

7. Support means according to claim 6 wherein said means to locate the baffle to be upstanding from the base comprises a plurality of baffle locating spigots upstanding from the base and a corresponding plurality of tabs outstanding from baffle, each tab having an aperture the walls of which slidably engage a respective said spigot when the baffle is within the tank.

8. Support means according to claim 6 wherein said baffle comprises two baffle portions, and means interengaging said portions end to end.

9. Support means according to claim 6 wherein said baffle contains water flow apertures extending through its walls near their lower edges.

10. Support means according to claim 6 wherein said support surfaces include support flanges extending near the upper edge of the rear of the baffle.

* * * * *